US011306442B2

(12) United States Patent
Rützel et al.

(10) Patent No.: US 11,306,442 B2
(45) Date of Patent: Apr. 19, 2022

(54) RAIL FASTENING SYSTEM

(71) Applicant: SCHWIHAG AG, Tägerwilen (CH)

(72) Inventors: Tilman Rützel, Constance (DE); Stefan Lienhard, Constance (DE); Frank Meyer, Stockach (DE)

(73) Assignee: SCHWIHAG AG, Tägerwilen (CH)

( * ) Notice: Subject to any disclaimer, the term of this patent is extended or adjusted under 35 U.S.C. 154(b) by 356 days.

(21) Appl. No.: 16/513,868

(22) Filed: Jul. 17, 2019

(65) Prior Publication Data

US 2020/0024808 A1 Jan. 23, 2020

(30) Foreign Application Priority Data

Jul. 19, 2018 (DE) ..... 10 2018 117 453.5

(51) Int. Cl.
*E01B 9/48* (2006.01)
*E01B 9/68* (2006.01)

(52) U.S. Cl.
CPC ..... *E01B 9/48* (2013.01); *E01B 9/681* (2013.01); *E01B 9/685* (2013.01)

(58) Field of Classification Search
CPC . E01B 9/48; E01B 9/681; E01B 9/685; E01B 7/22; E01B 9/42; E01B 9/38; E01B 9/68; E01B 9/44; E01B 9/60; E01B 9/483; E01B 9/62; E01B 9/66; E01B 9/46; E01B 9/303; E01B 2201/04; E01B 9/30
USPC ..... 238/7, 377
See application file for complete search history.

(56) References Cited

U.S. PATENT DOCUMENTS 1,613,142 A * 1/1927 Stults ..... E01B 9/42 238/291
1,767,647 A * 6/1930 Beckman ..... E01B 9/42 238/290
2,009,309 A * 7/1935 Davies ..... E01B 9/683 238/283
2,162,604 A * 6/1939 Clow ..... E01B 9/16 238/373
4,572,431 A * 2/1986 Arato ..... E01B 9/46 238/20

(Continued)

FOREIGN PATENT DOCUMENTS

BE 826013 A * 6/1975 ..... E01B 7/02
CN 1064327 C 4/2001

(Continued)

OTHER PUBLICATIONS

Lienhardt et al., copening U.S. Appl. No. 15/929,866, not yet published.

*Primary Examiner* — Mark T Le
(74) *Attorney, Agent, or Firm* — Smartpat PLC

(57) ABSTRACT

Rail fastening system for fastening at least one rail (2) to a rail substrate, preferably a solid travel path, which comprises: a rail support plate (1) arranged for holding the rail (2), wherein the rail (2) in the mounted state is in contact with the rail support plate and is fastened thereto by a rail mount (1*a*, 1*b*, 1*c*); a base plate (3) arranged for fastening the rail support plate (1) on the rail substrate, wherein the rail support plate (1) in the mounted state is fastened on the base plate (3) by way of one or more, preferably two, retaining elements (6) and the base plate (3) is in contact with the rail substrate; wherein the base plate (3) is of multi-part, preferably two-part, construction so that this is adjustable to different dimensions of the rail support plate (1).

18 Claims, 2 Drawing Sheets

(56) References Cited

U.S. PATENT DOCUMENTS

| | | | | |
|---|---|---|---|---|
| 5,249,743 | A | 10/1993 | Leingang et al. | |
| 6,257,495 | B1 | 7/2001 | Eisenberg | |
| 6,471,139 | B1 | 10/2002 | Bruder et al. | |
| 2008/0093472 | A1 | 4/2008 | Hohne et al. | |
| 2010/0301126 | A1 | 12/2010 | Meyer | |
| 2011/0204154 | A1 | 8/2011 | Boesterling et al. | |
| 2013/0153671 | A1 | 6/2013 | Bösterling et al. | |
| 2013/0168460 | A1 | 7/2013 | Bösterling et al. | |
| 2013/0228634 | A1* | 9/2013 | Bosterling | E01B 9/18 238/377 |
| 2013/0240635 | A1* | 9/2013 | Bosterling | E01B 9/303 238/349 |
| 2013/0264394 | A1* | 10/2013 | Wang | E01B 3/40 238/7 |
| 2015/0136865 | A1 | 5/2015 | Walter et al. | |
| 2016/0002864 | A1 | 1/2016 | Abalo et al. | |
| 2016/0138226 | A1 | 5/2016 | Buda | |
| 2020/0024808 | A1 | 1/2020 | Rützel et al. | |
| 2020/0378069 | A1 | 12/2020 | Lienhard et al. | |

FOREIGN PATENT DOCUMENTS

| | | | | | |
|---|---|---|---|---|---|
| CN | 1260850 | C | | 6/2006 | |
| CN | 1981089 | A | | 6/2007 | |
| CN | 201077936 | | | 6/2008 | |
| CN | 204849494 | U | | 12/2015 | |
| CN | 207468994 | U | | 6/2018 | |
| DE | 2406957 | A | * | 8/1975 | |
| DE | 2600416 | B1 | | 3/1977 | |
| DE | 2806817 | C2 | | 8/1981 | |
| DE | 10139198 | A1 | | 4/2003 | |
| DE | 102004031632 | A1 | | 1/2006 | |
| DE | 102006057911 | A1 | | 6/2008 | |
| DE | 202013103235 | U1 | | 8/2013 | |
| DE | 102010038442 | | | 10/2016 | |
| GB | 1489882 | A | | 10/1977 | |
| KR | 20020033337 | A | | 5/2002 | |
| RU | 2239012 | C2 | | 10/2004 | |
| RU | 2459897 | C2 | | 8/2012 | |
| RU | 2541558 | C2 | | 2/2015 | |
| RU | 2605813 | C2 | | 12/2016 | |
| WO | 2005017258 | A1 | | 2/2005 | |
| WO | 2005124025 | A1 | | 12/2005 | |
| WO | 2007082553 | A1 | | 7/2007 | |
| WO | 2010017843 | A1 | | 2/2010 | |
| WO | WO-2013060094 | A1 | * | 5/2013 | E01B 9/60 |
| WO | 2014016246 | A1 | | 1/2014 | |
| WO | 2017215757 | A1 | | 12/2017 | |

* cited by examiner

RAIL FASTENING SYSTEM

TECHNICAL FIELD

The disclosure relates to a rail fastening system for fastening a rail to a rail substrate, preferably to a solid travel path. The rail fastening system comprises a rail support plate arranged for holding the rail and a base plate arranged for fastening the rail support plate to the rail substrate.

BACKGROUND

For high-speed stretches and stretches with heightened demands on noise reduction and vibration damping, for example in tunnels or for underground railways, rail tracks and points are laid on sleepers or on a so-called 'solid travel path'. The solid travel path is usually a flat continuous concrete slab which serves, instead of a superstructure of ballast, as a substrate for the tracks. In order to fasten a railway rail on a solid travel path use is made of rail support plates and intermediate plates which are at least partly flexible. When a wheel of the rail vehicle rolls over, the travel rail or stock rail deflects due to the flexible mounting, as a result of which noise and vibrations are damped.

According to one mode of construction highly resilient plastics material intermediate plates are used between the rail support plate and the sleeper or the solid travel path. Thus, WO 2007/082553 A1 describes a system for fastening a rail to a solid substrate. The system comprises an intermediate layer which consists of a resilient material and which in the mounted state of the system rests on the solid substrate. Further known modes of construction are evident from WO 2005/017248 A1, DE 101 39 198 A1 and US 2013/0168460 A1.

Due to the multiplicity of different rail support plates, particularly in the area of points (slide-chair, roller, rib, wheel-guiding and frog plates), it is desirable to design rail fastening systems so that they are universally adaptable and usable. In this case, in particular, technical problems are connected with the reliable transmission of transverse force from the wheel of the rail vehicle to the concrete slab.

It is known to realise transverse force absorption by specially shaped shoulders in the concrete slab. Alternatively, several, normally two, fastening elements per side can be used. However, in the latter case, due to component tolerances and production tolerances of, in particular, the concrete slab it is impossible to distribute the transverse force uniformly to the several installed fastening elements. In this sense, the system is technically over-determinate.

The fastening structure according to DE 101 39 198 A1 in fact needs only one fastening element per side and no additional concrete shoulder, but an appreciable height regulation of the rail, for example by intermediate plates between the sleeper and the rail support plate, is not readily possible, since otherwise the transverse force loading on the angle guide plate would be too high.

US 2013/0168460 A1 describes a fastening structure in which use is made of substitute shoulders which are integrally connected with one another so as to conduct away the arising transverse forces via a respective fastening element per side. However, under actual operating conditions the loading is non-uniform due to production tolerances, i.e. the transverse forces are primarily dissipated via one fastening element. Thus, this system is also over-determinate. Moreover, mounting and demounting of the system is hampered by the high substitute shoulders.

SUMMARY

An object of the invention is to provide an improved rail fastening system for fastening a rail to a rail substrate, preferably a solid travel path.

The object is fulfilled by a rail fastening system as claimed. Advantageous configurations are described in the dependent claims, the following summary, and the description of preferred embodiments.

The rail fastening system serves for detachable fastening of a rail to a rail substrate. The rail substrate is preferably a solid travel path, for example, a base of concrete, but can also be a track sleeper or other suitable rail substrate. The rail fastening system comprises a rail support plate arranged for holding the rail, wherein the rail in the mounted state is for this purpose in contact with the rail support plate and fastened thereto by a rail mount. The rail support plate is, for example, a shaped part of steel. The rail fastening system further comprises a base plate which is arranged for fastening the rail support plate on the rail substrate, wherein the rail support plate in the mounted state is fastened on the base plate by way of one or more, preferably two, retaining elements and the base plate is in contact with the rail substrate. For preference, one retaining element per side is provided. The rail support plate and the base plate in that case do not necessarily have to be in direct contact with one another, since it is possible to provide between the two plates, for example, one or more spacer plates (described in detail further below) and/or one or more flexible intermediate plates (similarly described in detail further below). The base plate ensures connection of the rail fastening system with the rail substrate.

The base plate is of multi-part, preferably two-part, construction, so that this is adjustable to different dimensions of the rail support plate. The division of the base plate is in that case preferably provided in such a way that adjustability along the transverse direction is realized. The "transverse direction" in that regard denotes any direction perpendicular to the plane formed by the length direction of the rail and gravitational force. The transverse direction thus corresponds with the main length direction of a sleeper in the mounted state. It may be mentioned that the designations "top", "bottom", "vertical", "perpendicular", "transverse", "longitudinal", etc., are clear in this context since the rail and the rail fastening system in the mounted state have a unique position with respect to use.

Since the base plate is of multi-part construction, for example with a first base plate section and a second base plate section adjustable relative thereto, the base plate can be adapted to different rail support plates, for example in the blade, intermediate-rail and frog regions of points. The rail fastening system is thus universally adaptable and at the same time ensures reliable transmission of force, particularly transverse force, from the wheel of a rail vehicle to the rail substrate.

Further, the rail fastening system preferably comprises at least one intermediate plate of a flexible material which in the mounted state is arranged between the base plate and the rail support plate. The intermediate plate improves the mounting of the rail support plate and serves for shock and sound decoupling between the rail and the rail substrate. The material of the intermediate plate preferably has a static stiffness of approximately 200 kN/mm or less. The intermediate plate can similarly be of multi-part construction so as to further improve the adaptability of the rail fastening system.

The rail fastening system preferably further comprises at least one spacer plate which in the mounted state is arranged between the base plate and the rail support plate. Compensation for possibly present height tolerances of the rail substrate can be provided by the spacer plate. The spacer plate is made of, for example, a metal or a plastics material. The spacer plate is preferably of multi-part, for example two-part, construction so that this is adjustable to different dimensions of the rail support plate. In this way the adaptability of the rail fastening system can be further improved.

The retaining elements preferably each comprise one or more tightening clamps arranged to press the rail support plate against the base plate by a defined force. For this purpose, the retaining elements can be constructed so that the tightening clamps thereof engage over the ends of the rail support plate and press these onto the base plate. The rail support plate is in this way held in height direction.

The tightening clamps are preferably constructed with a high vertical fatigue limit, wherein the exact shape, material strength and spring constant can vary according to the respective use.

The retaining elements preferably each comprise a respective angle guide plate, the angle guide plates being arranged for defined fixing of the orientation and position and for supporting an associated tightening clamp. In this way, the desired retaining forces can be realized reliably and permanently.

For preference the retaining elements, for example the angle guide plates thereof, are so arranged that in the mounted state these are positioned in transverse direction respectively in flush abutting contact with an end face of the rail support plate, wherein the contacting end faces of the rail support plate and the retaining elements are so arranged that they enter into an interlocking connection. For this purpose, the angle guide plates are, for example, of T-shaped construction so that a projection thereof in the mounted state engages in a corresponding recess at the end face of the rail support plate, whereby the contacting end faces of the rail support plate and the angle guide plate enter into an interlocking connection. In this way, longitudinal migration of the rail support plate is precluded in constructionally simple manner.

The retaining elements preferably each comprise a respective peg and screw-shaped fastening element anchored by the peg in the rail substrate. With particular preference, the retaining elements are so arranged that the pegs when the base plate is mounted can be rotated from above out of the rail substrate. All components are thus exchangeable in simple manner. This applies particularly also when the pegs are embedded in a rail substrate of concrete. Maintenance of the rail fastening system, exchange of components, etc., can be carried out without destroying or damaging the rail substrate.

For preference, the base plate has substitute shoulders at the two end sections in transverse direction, the shoulders being arranged to stabilize the rail support plate in transverse direction. The transverse forces can in this way be conducted away more reliably into the rail substrate.

The underside of the base plate preferably has a structure consisting of elevations and depressions, for example a chamber structure, which is arranged to indent with the rail substrate, whereby the base plate is further stabilized on the rail substrate.

Further advantages and features of the present invention are evident from the following description of preferred embodiments. The features described therein can be realized by themselves or in combination with one or more of the above-mentioned features insofar as the features do not conflict. The following description of the preferred embodiments is in that case made with reference to the accompanying drawings.

DETAILED DESCRIPTION

Figure 1:
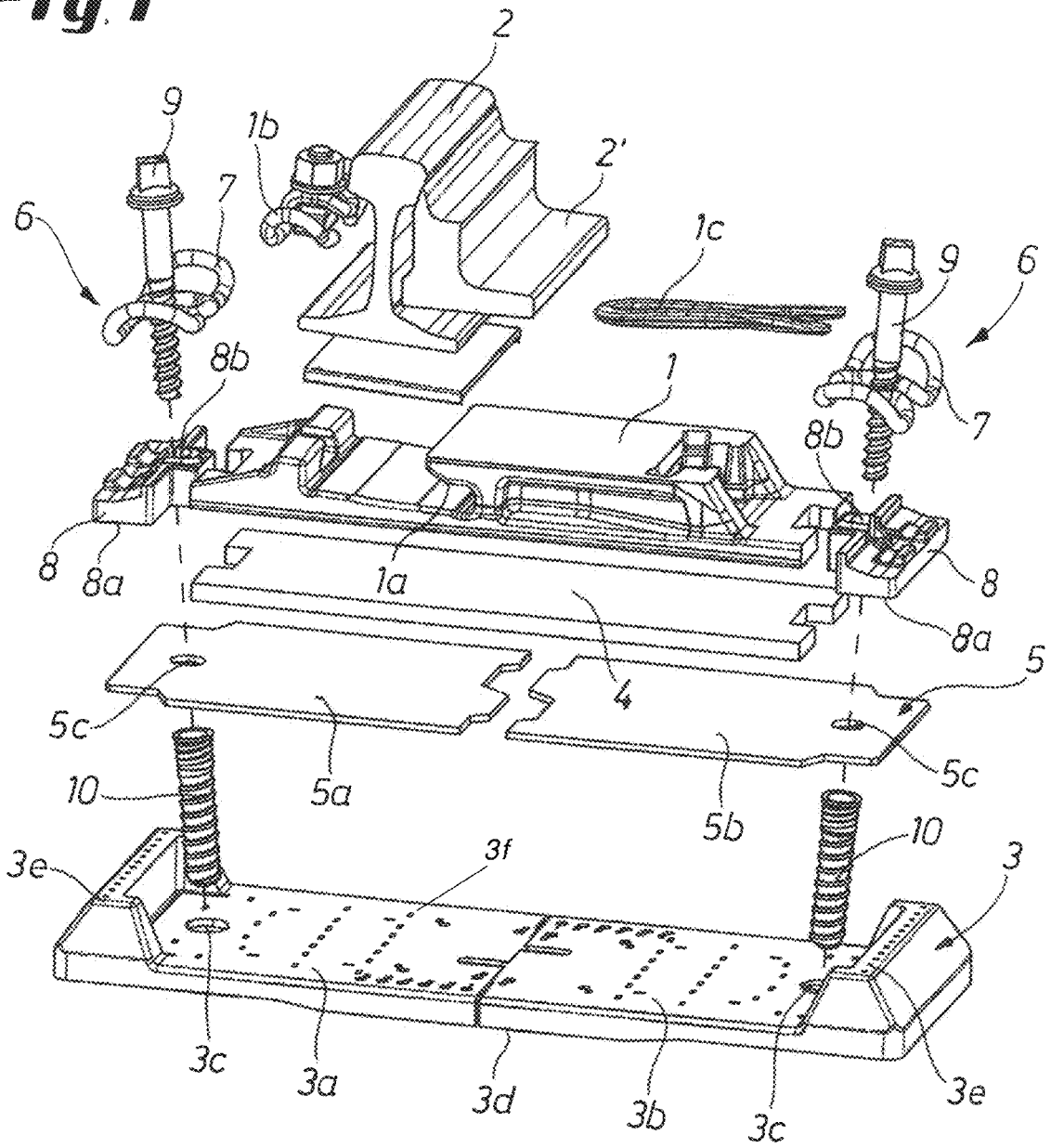
FIG. 1 is a perspective exploded view showing a rail fastening system and a rail to be fastened by that to a solid travel path.

Preferred embodiments are described in the following on the basis of the figures. In that case the same, similar or equivalent elements are provided in the figures with identical reference numerals and repeated description of these elements is partly dispensed with so as to avoid redundancies.

Figure 2:
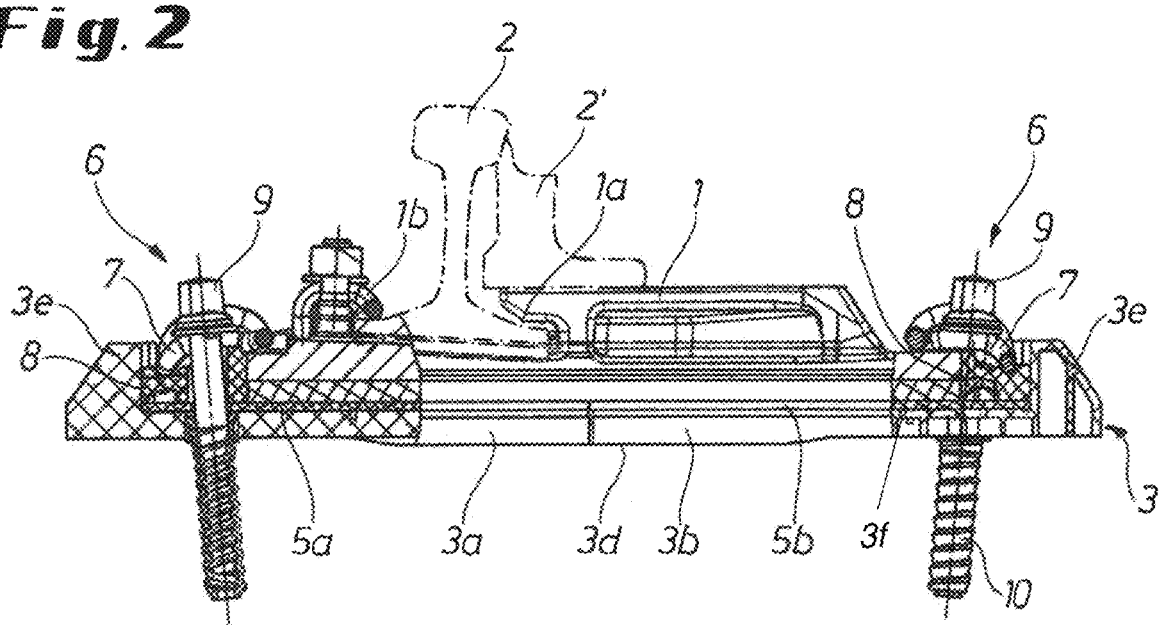
FIG. 2 is a schematic cross-sectional view of the rail fastening system.
Figure 3:
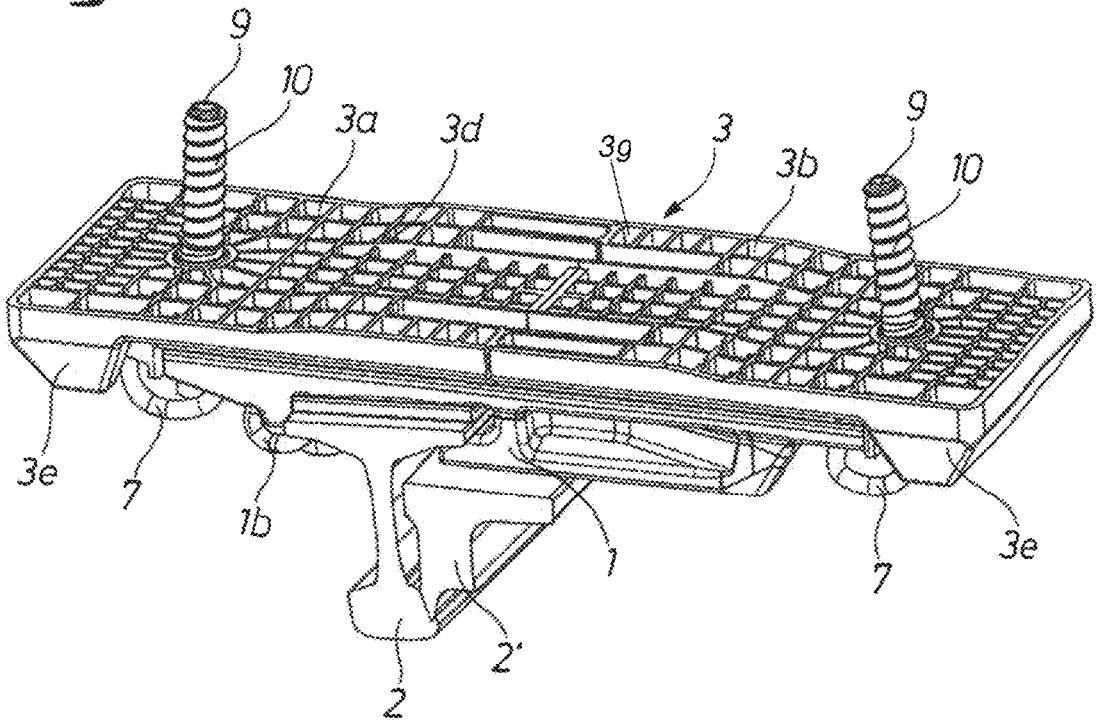
FIG. 3 shows the rail fastening system, obliquely from below, in the mounted state.

The rail fastening system, illustrated in FIGS. 1 to 3, comprises a rail support plate 1 for holding a rail 2 to be mounted thereon. The rail support plate 1 is, for example, a shaped part of steel.

In the present embodiment, the rail 2 is located in the region of points. For this reason, a further rail section 2' is shown in FIGS. 1 to 3. The rail section 2' rests on a corresponding section of the rail support plate 1 and is adjustable in transverse direction (the lefthand direction/righthand direction in the illustration of FIG. 2). It may be mentioned that the rail fastening system is also usable apart from points, i.e. in the normal track region. The exact form of the rail support plate 1 can in that case be adapted to the respective use environment.

The rail support plate 1 has a rail holding section 1*a* which determines the position of the rail 2 on the rail support plate and contributes to holding the rail 2. The rail 2 is additionally tightened by one or more rail tightening clamps 1*b* and/or rail clamping yokes 1*c* against the rail support plate 1. The rail holding section 1*a*, the rail tightening clamps 1*b* and the rail clamping yokes 1*c* form an exemplifying realization for a rail mount equipped for fastening the rail 2 to the rail support plate 1.

An intermediate plate 4, which is part of the rail fastening system, of a flexible material can be arranged between the rail support plate 1 and a base plate 3 (described in detail further below). The intermediate plate is, for example, a highly resilient plate of an elastomer and preferably has a static stiffness of approximately 200 kN/mm or less. The intermediate plate 4 guarantees optimum mounting of the rail support plate 1 and serves for shock and sound decoupling between the rail 2 and a rail substrate, which is not shown in FIGS. 1 to 3.

In addition, the rail fastening system can comprise a spacer plate 5, which is disposed below the intermediate plate 4, to provide compensation for possible height tolerances of the rail substrate. The spacer plate 5 can be made from a metal or a plastics material. According to the present embodiment the spacer plate 5 is similarly of two-part construction, with a first spacer plate section 5*a* and a second spacer plate section 5*b*.

The rail fastening system further comprises a base plate 3, to which the rail support plate 1, the optional intermediate plate 4 and the optional spacer plate 5 are fastened. The base plate 3 ensures connection of the rail fastening system with the rail substrate. In the present example the base plate 3 has at the two end sections in transverse direction substitute shoulders 3*e* arranged to stabilize the rail support plate 1 in transverse direction.

The base plate 3 is of multi-part construction, in the present embodiment two-part construction, with a first base plate section 3*a* and a second base plate section 3*b*. In this way the base plate 3 can be adapted to different rail support plates 1, for example in the blade, intermediate-rail and frog region of points.

The rail support plate 1 is fixed in its position on the base plate 3 by way of two retaining elements 6. A respective one of the retaining elements 6 (more precisely, the angle guide plates 8 thereof described further below) is positioned on each side in transverse direction to be flushly abutting in front of an end face of the rail support plate 1. The contacting end faces of the rail support plate 1 and the retaining element 6 can have co-operating shapes (projections, depressions, etc.) so as to realize a mechanically positive connection. In this way, longitudinal migration of the rail support plate 1 is precluded. The retaining elements 6 and/or the rail support plate 1 can have different or further means for mechanically positive and/or frictional connection so as to ensure secure mounting of the rail support plate on the base plate 3.

The retaining elements 6 each comprise a respective tightening clamp 7, which clamps engage over the ends of the rail support plate 1 and urge this by a defined force against the base plate 3. The rail support plate 1 is held in height direction in this way. The tightening clamps 7 are constructed with an optimum clamping force and a high vertical fatigue limit, wherein the exact shape, material strength and spring constant can vary depending on the respective use.

The retaining elements 6 each further comprise a respective angle guide plate 8, the undersides of the plates being formed as defined pressure surfaces 8*a* for support on the base plate 3. The angle guide plates 8 are preferably of T-shaped construction so as to realize the above-mentioned mechanically positive mounting of the retaining elements 6. The angle guide plates 8 serve for defined guidance and support of the tightening clamps 7.

The angle guide plates 8 each have a passage opening 8*b* which is penetrated by a fastening element 9. The fastening element 9 in the present embodiment is constructed as a screw, which is anchored by way of a peg 10 in the rail substrate. The spacer plate 5 as well as the base plate 3 for this purpose similarly have passage openings 5*c*, 3*c* so that all components of the rail fastening system can be not only tightened relative to one another by tightening the screw-shaped fastening elements, but also fastened to the rail substrate.

In the present embodiment the angle guide plate 8 is in direct contact with the rail support plate 1. Alternatively, the angle guide plate 8 can be inserted into a frame (not shown) provided for that purpose, for example in order to be able to in this way equip the rail fastening system in modular manner with different types of angle guide plates 8.

The underside 3*d* of the base plate is, as evident from FIG. 3, preferably of chamber-like construction, whereby downwardly open chambers 3g indent into the rail substrate. In this way, wheel forces which occur can be conducted away into the rail substrate with particular reliability.

The above-mentioned rail fastening system is particularly suitable for mounting on a solid travel path constructed from concrete, in which case the pegs 10 are embedded in the concrete and at any time after installation can be rotated upwardly out of the base plate 3 without demounting this and can be exchanged. All components are thus exchangeable in simple manner.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

REFERENCE NUMERAL LIST

1 rail support plate
1*a* rail holding section
1*b* rail tightening clamp
1*c* rail clamping yoke
2 rail
2' rail section
3 base plate
3*a* first base plate section
3*b* second base plate section
3*c* passage opening
3*d* underside
3*e* substitute shoulder
4 intermediate plate
5 spacer plate
5*a* first spacer plate section
5*b* second spacer plate section
5*c* passage opening
6 retaining element
7 tightening clamp
8 angle guide plate
8*a* pressure surface
8*b* passage opening
9 fastening element
10 peg

What is claimed is:

1. A rail fastening system for fastening a rail (2) to a rail substrate, comprising:

a rail support plate (1) arranged for holding the rail (2), wherein the rail (2) is in contact with the rail support plate and is fastened thereto by a rail mount (l*a*, l*b*, l*c*); and a base plate (3) arranged for fastening the rail support plate (1) on the rail substrate, wherein the rail support plate (1) is fastened on the base plate (3) by one or more retaining elements (6) and the base plate (3) is in contact with the rail substrate, wherein the base plate (3) is of multi-part construction in the form of at least two separate pieces having adjacent facing ends each configured with alternating projections and recesses arranged along the longitudinal axis of the rail and thereby adjustable to different dimensions of the rail support plate (1), wherein the rail mount comprises a rail holding section (l*a*) formed in the rail support plate (1) which overlaps a base of the rail (2) on one side and a rail tightening clamp (1*b*) which overlaps the base of the rail (2) on an opposite side.

2. The rail fastening system according to claim 1, further comprising at least one intermediate plate (4) of a flexible material, wherein the intermediate plate (4) is arranged between the base plate (3) and the rail support plate (1).

3. The rail fastening system according to claim 2, wherein the at least one intermediate plate (4) of a flexible material has a static stiffness of 200 kN/mm or less.

4. The rail fastening system according to claim 1, further comprising at least one spacer plate (5) which is arranged between the base plate (3) and the rail support plate (1), wherein the spacer plate (5) is of multi-part construction and thereby adjustable to different dimensions of the rail support plate (1).

5. The rail fastening system according to claim 1, wherein the retaining elements (6) each comprise one or more tightening clamps (7) arranged so as to press the rail support plate (1) with a defined force onto the base plate (3).

6. The rail fastening system according to claim 5, wherein the retaining elements (6) each comprise an angle guide plate (8) arranged for defined fixing of an orientation and a position as well as for supporting an associated tightening clamp (7).

7. The rail fastening system according to claim 6, wherein the angle guide plates (8) are of T-shaped construction so that a projection thereof engages in a corresponding recess at an end face of the rail support plate (1), whereby contacting end faces of the rail support plate (1) and the angle guide plates (8) enter into an interlocking connection.

8. The rail fastening system according to claim 1, wherein the retaining elements (6) are so arranged that they are positioned in a transverse direction respectively in flush abutting contact with an end face of the rail support plate (1), and wherein contacting end faces of the rail support plate (1) and the retaining elements (6) are so arranged that they enter into an interlocking connection.

9. The rail fastening system according to claim 1, wherein the retaining elements (6) each comprise a peg (10) and a screw-shaped fastening element (9) anchored by the peg (10) in the rail substrate.

10. The rail fastening system according to claim 9, wherein the retaining elements (6) are so arranged that (10) when the base plate (3) is mounted can be turned from above out of the rail substrate.

11. The rail fastening system according to claim 1, wherein the base plate (3) has at two end sections in transverse direction substitute shoulders (3*e*) arranged to stabilize the rail support plate (1) in transverse direction.

12. The rail fastening system according to claim 1, wherein an underside (3*d*) of the base plate (3) comprises a structure of elevations and depressions arranged to indent with the rail substrate.

13. The rail fastening system according to claim 12, wherein the structure of elevations and depressions is a chamber structure.

14. The rail fastening system according to claim 1, wherein the rail substrate is a solid travel path.

15. The rail fastening system according to claim 1, wherein the rail support plate is fastened on the base plate (3) by two retaining elements.

16. The rail fastening system according to claim 1, wherein the base plate (3) is of two-part construction.

17. The rail fastening system according to claim 1, wherein the retaining elements (6) comprises two angle guide plates (8) in positive locking engagement with opposite transverse end faces of the rail support plate (1) and two clamps (7) which each overlap one of the guide plates (8) and the rail support plate (1).

18. The rail fastening system according to claim 1, wherein the one or more retaining elements (6) include a first retaining element and a second retaining element and wherein the rail (2) is arranged closer to the first retaining element than the second retaining element.

* * * * *